US007389881B2

(12) United States Patent
Andreatidis et al.

(10) Patent No.: US 7,389,881 B2
(45) Date of Patent: Jun. 24, 2008

(54) FLOTATION

(75) Inventors: John Patrick Andreatidis, Mountgravett (AU); Christofo Torrisi, Roxby Downs (AU)

(73) Assignee: BHP Billiton Pty Ltd (AU)

( * ) Notice: Subject to any disclaimer, the term of this patent is extended or adjusted under 35 U.S.C. 154(b) by 289 days.

(21) Appl. No.: 10/473,123

(22) PCT Filed: Mar. 28, 2002

(86) PCT No.: PCT/AU02/00400

§ 371 (c)(1),
(2), (4) Date: May 4, 2004

(87) PCT Pub. No.: WO02/078851

PCT Pub. Date: Oct. 10, 2002

(65) Prior Publication Data

US 2004/0182755 A1 Sep. 23, 2004

(30) Foreign Application Priority Data

Mar. 30, 2001 (AU) ..... PR4108

(51) Int. Cl.
*B03D 1/002* (2006.01)
*B03D 1/02* (2006.01)

(52) U.S. Cl. ..... 209/164; 209/166

(58) Field of Classification Search ..... 209/166, 209/167, 164
See application file for complete search history.

(56) References Cited

U.S. PATENT DOCUMENTS 1,157,176 A * 10/1915 Owen ..... 209/167
5,700,369 A 12/1997 Zhou et al.

FOREIGN PATENT DOCUMENTS

AU 9723540 * 11/1997
CA 1095640 * 2/1981
DE 3626920 A1 2/1988

OTHER PUBLICATIONS

Handbook of Mineral Dressing—Ores and Industrial Minerals (Arthur F. Taggart) John Wiley & Sons, Inc. copyright 1927. See chapter 12 pp. 29-33, 93-96.

* cited by examiner

*Primary Examiner*—Thomas M. Lithgow
(74) *Attorney, Agent, or Firm*—Miles & Stockbridge P.C.; David R. Schaffer, Esq.

(57) ABSTRACT

A method of recovering a valuable component from a feed slurry in minerals processing plant for a mined material is disclosed. The method includes separating the feed slurry on the basis of particle size into at least two streams, of which one stream is a fines stream. The pH of the fines stream is then adjusted to be within a range in which contaminants on the surface of the fines are soluble so that contaminants dissolve from the surface of the fines. Thereafter, the valuable component is floated from the pH adjusted fines stream.

18 Claims, 4 Drawing Sheets

FLOTATION

The present invention is a method of recovering a valuable component from a feed slurry in a mineral processing plant for a mined material.

The present invention is concerned particularly, although by no means exclusively, with recovering a valuable component from a feed slurry in a flotation circuit of a mineral processing plant for a mined material that includes metal sulphides and/or metallic minerals. The main valuable components in metal sulphides and metallic minerals from an economic viewpoint include silver, lead, copper, nickel, zinc, cobalt, molybdenum, tin and iron.

The present invention relates more particularly, although by no means exclusively, to recovering a valuable component, namely silver and lead, from a feed slurry in a flotation circuit of a mineral processing plant for a mined material, namely a silver-rich lead deposit.

The present invention was made during the course of a research program carried out at the Cannington mine of the applicant.

The Cannington mine, located in North Queensland, is a silver-rich lead and zinc deposit. The mineral processing plant at the mine produces a lead concentrate and a zinc concentrate. The concentrates contain silver, and the silver is separated from the concentrates in subsequent refining of the concentrates. The feed to the mineral processing plant is a blend of a number of different lead and zinc bearing ores with varying silver, lead and zinc compositions. The lead and zinc in the ores are predominantly in the form of Sulphides including galena (PbS) and sphalerite (ZnS). The ores contain 15-25 wt. % lead sulphides and 5-10 wt. % zinc sulphides. The ores also contain 30-50 wt. % iron/manganese silicates and 15-20 wt. % iron sulphides.

The applicant has found that significant amounts of silver and lead are lost in the tailings from the flotation circuit of the minerals processing plant.

The applicant has determined that one of the reasons for the loss is that the flotation stage is not able to float fines of less than 5 micron efficiently.

The applicant believes that poor flotation performance of fines is due to surface contamination of fines.

The applicant believes that one source of surface contamination is mineral oxidation species or metal hydroxide species from the plant feed on the fines.

In relation to the Cannington mine the applicant has found that poor flotation performance of fines can be significantly alleviated by a method that includes:

(a) splitting a fines stream from a bulk stream feed;

(b) adjusting the pH of the fines stream to be within a range that dissolves surface contaminants on the fines; and (c) thereafter floating silver and lead from the pH adjusted fines stream.

The present invention is concerned with the above-described treatment of fines in a feed slurry.

In more general terms, the applicant has realized that surface contamination due to mineral oxidation species or metal hydroxide species may not always be confined to fines and may be present on other particle size fractions in a feed slurry or on the whole particle size distribution in a feed slurry.

The present invention is also concerned with this more general treatment of a feed slurry.

According to one aspect of the present invention there is provided a method of recovering a valuable component from a feed slurry in a minerals processing plant for a mined material which includes the steps of:

(a) separating the feed slurry on the basis of particle size into at least two streams;

(b) adjusting the pH of at least one of the split streams to be within a range in which contaminants on the surface of particles in the split stream are soluble and thereby dissolving contaminants from the surface; and (c) floating the valuable component from the pH adjusted split stream.

Preferably step (b) includes adjusting the pH of a fines stream split from the feed slurry.

Preferably the mined material includes metal sulphides and/or metallic minerals.

It is preferred particularly that the mined material includes metal sulphides that have surface contaminants due to mineral oxidation species or metal hydroxide species.

The valuable components may be any one or more of silver, lead, copper, nickel, zinc, cobalt, molybdenum, tin, and iron.

By way of example, the mined material is a silver-rich lead deposit that includes lead sulphides and the valuable component is silver and lead.

By way of particular example, the mined material is a silver-rich lead and zinc deposit that includes lead sulphides and zinc sulphides and the valuable component is any one or more of silver, lead, and zinc.

Preferably the valuable component is silver.

Preferably the flotation step (c) includes a lead flotation circuit.

In that event, the feed slurry for step (a) may be a feed slurry to the lead flotation circuit or a tails slurry from the lead flotation circuit.

Preferably the feed slurry for step (a) is a feed slurry to the lead flotation circuit.

Preferably the flotation step (c) includes a lead flotation circuit and a zinc flotation circuit.

In a situation where the lead flotation circuit precedes the zinc flotation circuit, preferably the feed slurry for step (a) is any one or more of:

(i) a feed slurry to the lead flotation circuit;

(ii) a tails slurry from the lead flotation circuit, i.e. a feed slurry to the zinc flotation circuit; and (iii) a tails slurry from the zinc flotation circuit.

Preferably in such a situation the feed slurry for step (a) is a feed slurry to the lead flotation circuit.

The flotation step (c) may include any other flotation circuits. By way of example, the flotation step may include a talc flotation circuit.

Preferably the pH range is $\leqq 5$ in pH adjustment step (b).

Preferably the pH range is 3-5.

More preferably the pH range is 3.5-4.5.

It is preferred particularly that the pH range be 4-4.5.

Preferably the fines are 10 micron or less in the fines stream produced in step (a).

More preferably the fines are 5 micron or less.

Preferably pH adjustment step (b) includes adding an acid to the feed slurry to adjust the pH to be within the required range.

The acid may be any suitable acid. Preferably the acid is sulphuric acid.

Preferably pH adjustment step (b) includes providing contact time for the contaminants to dissolve.

Preferably the contact time period is at least 5 minutes.

In a situation where the valuable component is silver, lead, and zinc, preferably step (c) of floating the valuable component in the pH adjusted fines stream includes:

(i) floating lead and silver in the pH adjusted fines stream from step (b) in a lead flotation circuit; and (ii) floating zinc and silver in a tails stream from the lead flotation circuit in a zinc flotation circuit.

A zinc depressant and a lead/silver collector may be added during and/or after pH adjustment step (b).

However, preferably the zinc depressant and the lead/silver collector are added to the pH adjusted fines after pH adjustment step (b).

More preferably the lead/silver collector is added just before and/or during step (c)(i) of floating the lead and silver in the pH adjusted fines stream in the flotation lead circuit.

According to another aspect of the present invention there is also provided a flotation stage of a mineral processing plant which includes the above-described method of recovering a valuable component from a feed slurry of the flotation stage.

Preferably the flotation stage includes floating the valuable component from the one or more than one other streams produced in step (a).

According to another aspect of the present invention there is provided a method of recovering a valuable component from a feed slurry in a minerals processing plant for a mined material which includes the steps of:

(a) adjusting the pH of the feed slurry to be within a range in which contaminants on the surface of particles in the feed slurry are soluble and thereby dissolving contaminants from the surface; and (b) floating the valuable component from the pH adjusted feed slurry.

Preferably the mined material includes metal sulphides and/or metallic minerals.

It is preferred particularly that the mined material includes metal sulphides that have surface contaminants due to mineral oxidation species or metal hydroxide species.

The valuable components may be any one or more of silver, lead, copper, nickel, zinc, cobalt, molybdenum, tin, and iron.

As noted above the present invention is based on a research program carried out by the applicant at the Cannington mine.

The current mineral processing plant at the Cannington mine includes the following stages.

1. Comminution—which produces a feed slurry.
2. Flotation—specifically, the following flotation circuits, in order:
   (a) talc flotation;
   (b) lead flotation; and
   (c) zinc flotation.
3. Leaching of fluorine bearing minerals, namely fluorite, from separate lead and zinc concentrates.
4. Dewatering froth from the lead and zinc circuits—which produces separate lead and zinc concentrates.
5. Tails disposal.

The applicant has found by size analysis of flotation tailings of the current Cannington mineral processing plant that over 50% of the silver and lead losses to final tailings occur in the fines fraction of the tailings.

The applicant has also found from plant data that fine, i.e. smaller than 5 micron, particles of silver minerals and lead minerals are poorly captured by the lead flotation circuit of the existing flotation stage. The results of the analysis of plant data are shown in FIG. 1.

BRIEF DESCRIPTION OF THE DRAWINGS

FIG. 1 is a plot of recovery versus particle size of each of silver, lead, zinc, magnesia, iron, and silica to the lead concentrate produced in the lead flotation circuit. FIG. 1 is derived from plant data. The figure shows that the recoveries of silver and lead in the fines fraction, i.e. 3-5 micron, of the plant feed to the lead concentrate is considerably lower than the recoveries of these metals in the next size fraction, i.e. 5 to 30 micron, of the plant feed to the lead concentrate.

Figure 1:
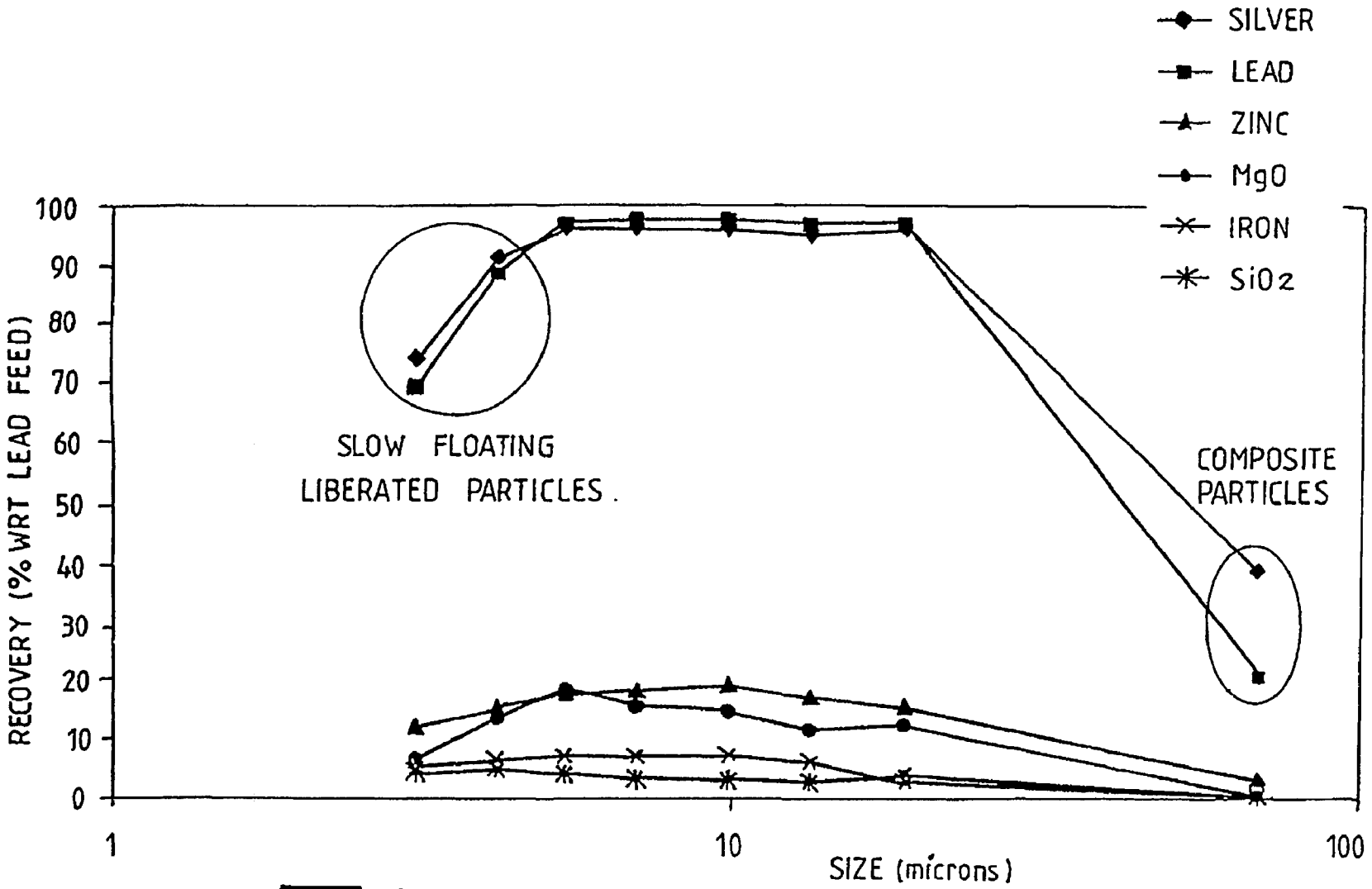
FIG. 1 is a plot of recovery versus particle size of each of silver, lead, magnesia, iron, and silica to the lead concentrate produced in the lead flotation circuit.

By way of example, with reference to FIG. 1, only 70 wt. % of the lead mineral particles and approximately 73 wt. % of the silver mineral particles in the 3 micron particles in the plant feed to the lead flotation circuit are recovered in the lead concentrate. By comparison, approximately 100 wt. % of the lead particles and the silver particles in the 10 micron particles in the plant feed to the lead flotation circuit are recovered in the lead concentrate.

The poor flotation performance of fine mineral particles, as exemplified by FIG. 1 for fine lead and silver particles, has been recognized for many years in the technical literature.

By way of example, an article by W. J. Trahar and L. J. Warren (1976) entitled "The Flotability of Very Fine Particles—A Review" in the International Journal of Mineral Processing reports that the overall flotation performance of a wide range of minerals deteriorated with particle size. The article also reports that the precise effects of particle size on grade, recovery and flotation kinetics are complex. The article also reports that there is no evidence of a critical size below which particles become unfloatable, even down to 1 micron.

The findings of Trahar and Warren are supported by an article by C. J. Greet, S. R. Grano, and J Ralston (1994) entitled "The Effects of Conditioning on the Flotation of Galena of Different Size Fractions", Fifth Mill Operators Conference. The article reports that at smaller particle sizes a constant specific flotation rate is approached.

After considering the above-mentioned plant data and information found in the above-mentioned technical documents (and other technical documents), the applicant investigated split flotation of fines and other size fractions of the plant feed using standard flotation practice as a possible solution to the poor flotation performance of fine lead and silver. The applicant found that there was a marginal improvement in the flotation performance of intermediate (20-38 micron) and coarse (+38 micron) size fractions when floated separately under the same flotation conditions used in flotation of the combined feed. The applicant also found that there was no improvement in flotation performance of the fines fraction (−20 micron) when the fines were floated separately. The applicant also found that higher recoveries of the fines could be achieved by using very high collector additions but that these high collector additions decreased selectivity between lead, zinc, silicates and iron markedly. In addition, the applicant found that the available retention time in the lead flotation circuit was insufficient to achieve high recoveries of fine lead and silver.

In the final analysis, the testwork did not support split flotation using standard flotation practice as a viable option for improving flotation performance of lead and silver fines.

The applicant carried out testwork to identify the mechanism that causes poor flotation performance of lead and silver particles in fines. The testwork investigated a range of possible mechanisms.

The results of the testwork established that surface contamination of fines causes poor flotation performance of lead and silver particles in fines.

The applicant investigated a range of options for removing surface contamination. The options were based on assumptions as to the source of surface contamination of fines.

Figure 2:
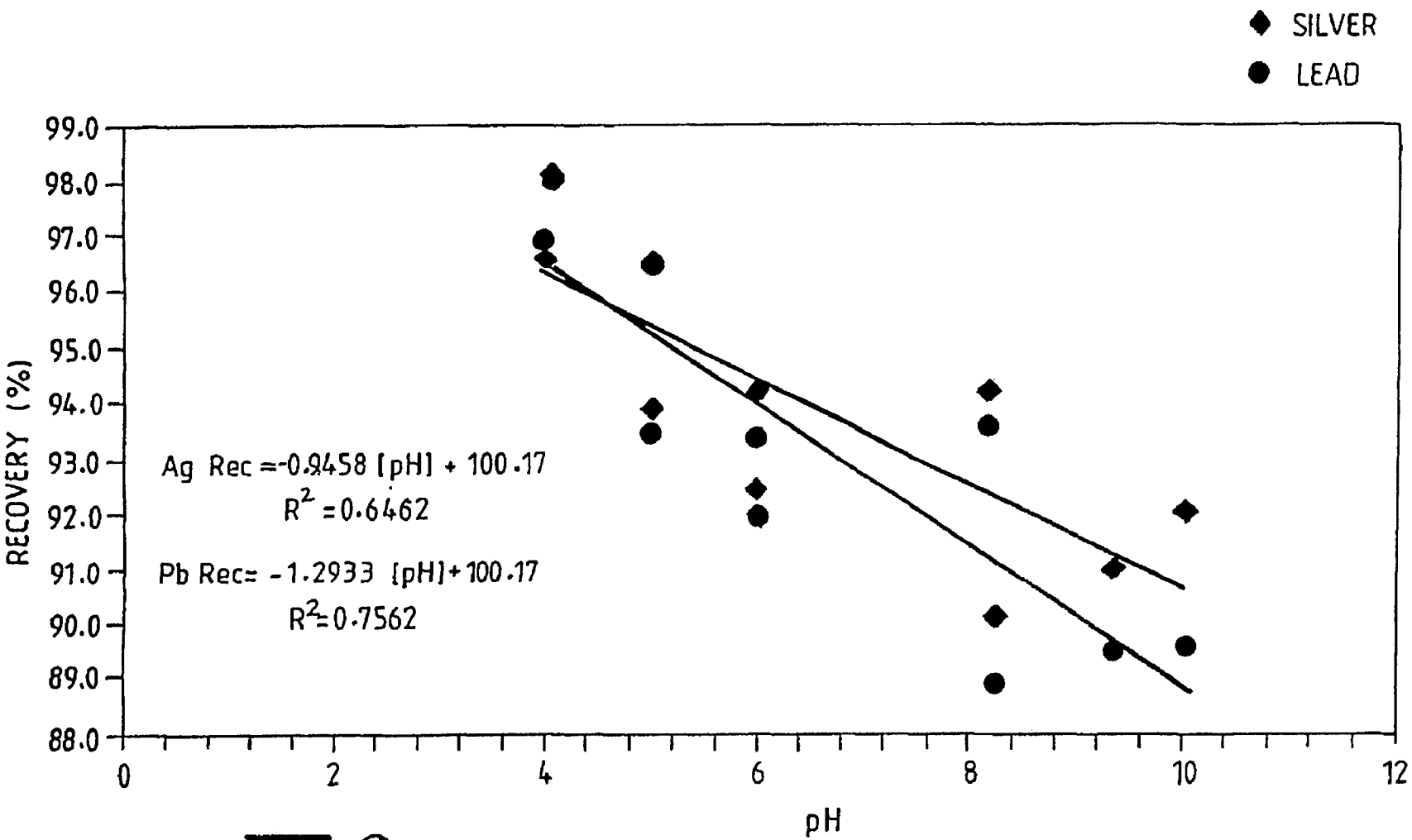
FIG. 2 is a plot of the effect of pH on infinite time recovery of fine lead and silver particles.
Figure 3:
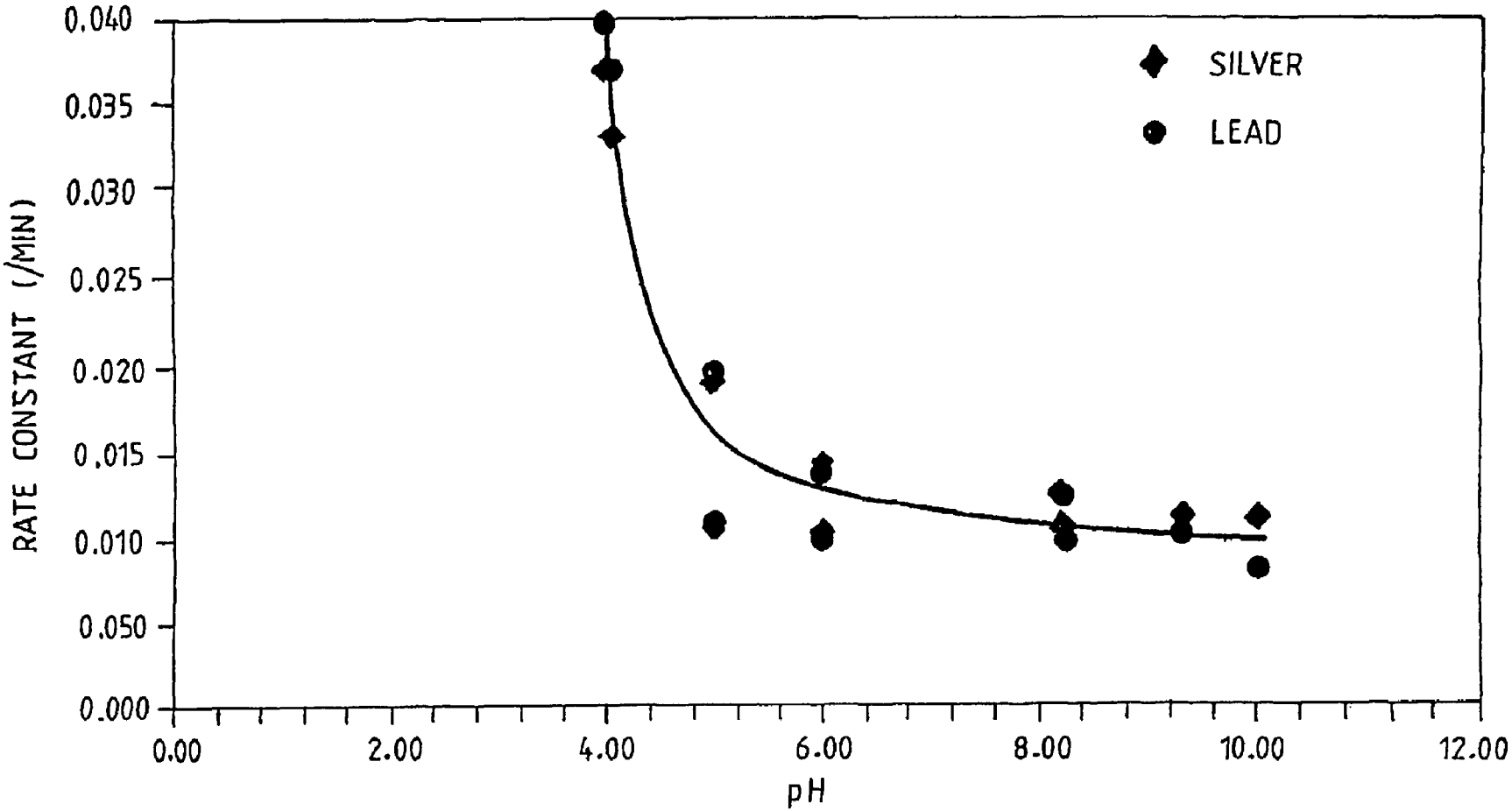
FIG. 3 is a plot of the effect of pH on the rate constant for the fines.

One option involved evaluating the effect of pH on fine particles. Testwork was carried out on plant feed having an average P80 of 8 micron. FIGS. 2 and 3 summarise the results of the testwork on the effect of pH.

FIG. 2 is a plot of the effect of pH on infinite time recovery of fine lead and silver particles. FIG. 3 is a plot of the effect of pH on the rate constant for the fines.

FIGS. 2 and 3 show that lead and silver recoveries and rate constants improved significantly if the fines slurry was conditioned at a pH of 5 or less.

The testwork also showed that selectivity of fine lead and silver particles against iron and silica particles was also improved at the low pH of 5 or less.

The testwork confirmed that surface contamination is a major cause of the poor flotation performance of the lead and silver fines. However, the testwork and further testwork carried out by the applicant has not established conclusively the precise nature of the surface contamination. Possible sources of surface contamination include mineral oxidation species or metal hydroxide species from the plant feed on the fines.

On the basis of the above-described testwork the applicant developed a method of improving flotation performance of fine lead and silver that includes:

(a) splitting a fines stream from a plant bulk stream feed;
(b) adjusting the pH of the fines stream to be 5 or less; and
(c) thereafter floating silver and lead from the adjusted pH fines stream.

Figure 4:
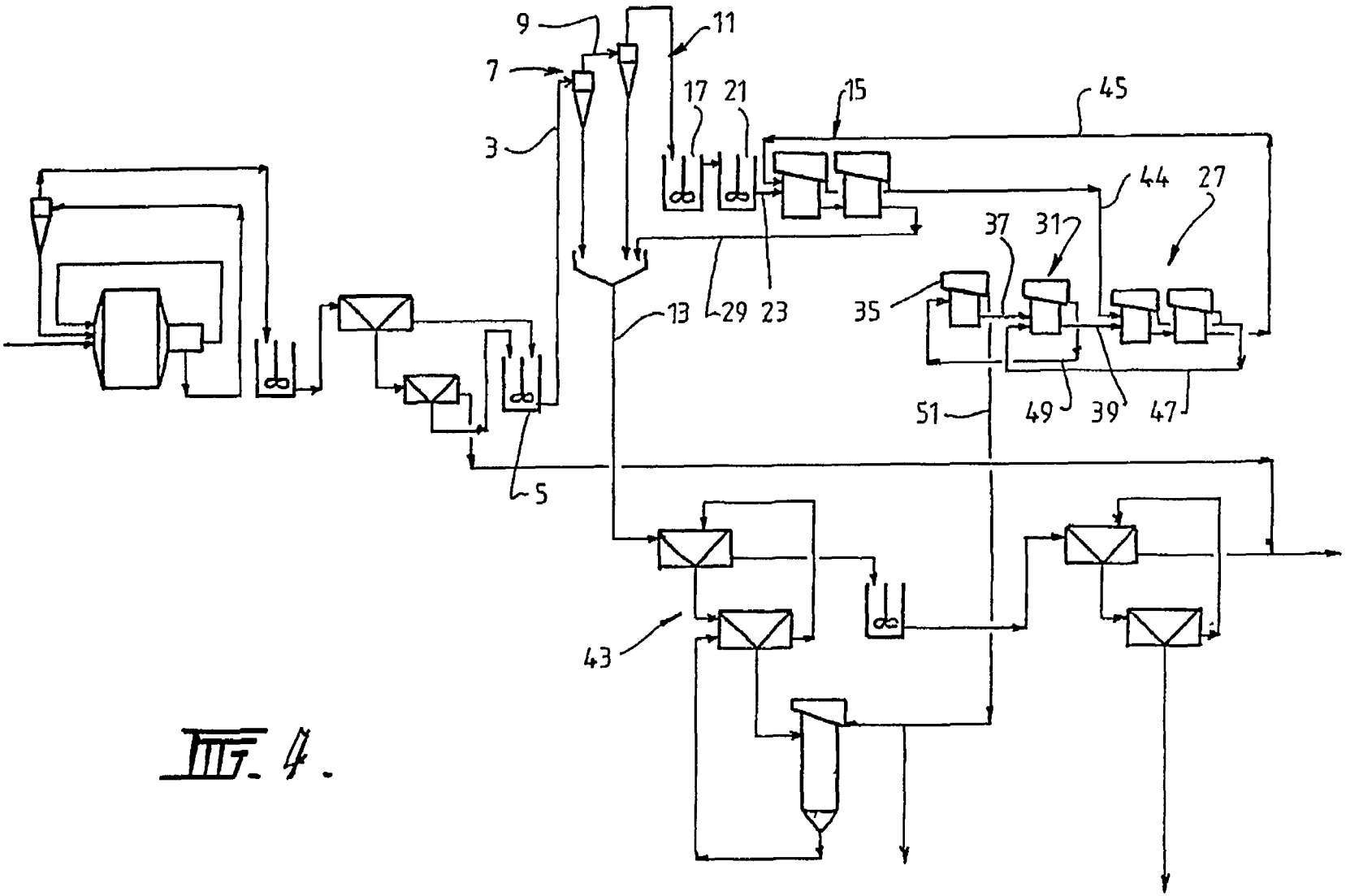
FIG. 4 is a flowsheet of a preferred embodiment of the method of the invention.

FIG. 4 is a flowsheet of a preferred embodiment of the method described in the preceding paragraph.

The flowsheet is designed to form part of the flotation stage at the Cannington mine.

With reference to FIG. 4, the fines flotation method begins with the classification of talc prefloat tailings to separate the fines (−5 micron) from the coarser fractions.

The prefloat tailings are pumped via line 3 from the existing lead conditioning tank 5 to a primary fines cyclone (150 mm) cluster 7 where a preliminary size split is made to reduce the flow requiring finer separation.

The overflow from the primary fines cyclone 7 is pumped via line 9 to a secondary fines cyclone (50 nm) cluster 11 where the fines fraction (<5 micron) is separated into the overflow.

Underflow from the primary and secondary fines cyclones 7, 11 are combined, diluted to the required solids concentration, and delivered by gravity via line 13 to the existing lead rougher flotation bank of the existing lead flotation circuit 43. The underflow is thereafter processed in accordance with standard Cannington practice in the lead flotation circuit 43.

The overflow from the secondary fines cyclone 11 is transferred to a lead conditioner tank 17.

In the lead conditioner tank 17 dilute sulphuric acid is added to the slurry to adjust the pH of the slurry to be 5 or less.

After a residence time of at least 5 minutes in conditioner tank 17, acidified (i.e. pH adjusted) slurry overflows into conditioner tank 21 and collectors, frother and zinc depressants are added to the slurry.

The conditioned slurry overflows from the conditioner tank 21 and is transferred via line 23 to a lead flotation circuit.

With reference to FIG. 4*b*, the lead flotation circuit includes a fines rougher bank 25 consisting of 2 of 100 $m^3$ tank flotation cells.

The concentrate from the rougher bank 25 is pumped by a centrifugal froth pump (not shown) via a line 44 to a cleaner bank 27 consisting of 2 of 40 $m^3$ tank cells. Tailings from the rougher bank 25 are pumped via line 29 to combine with and thereby dilute the underflow from the primary and secondary fines cyclones 7, 11.

The concentrate from the cleaner 27 is pumped via line 47 to a cleaner 31 which is a single 40 $m^3$ tank cell. The tailings from the cleaner 27 are pumped via line 45 to combine with conditioned slurry from the conditioner tank 21 that is being transferred via line 23 into the rougher bank 25.

The concentrate from the cleaner 31 is pumped via line 49 to a cleaner 35, a single 40 $m^3$ tank cell which produces a final lead fines concentrate that is transferred via line 51 for mixing with coarse lead concentrate from the existing lead flotation circuit 43 prior to leaching and filtration.

The tailings from the cleaner 35 gravitate via line 37 to the cleaner 31 and the tailings from the cleaner 31 gravitate via line 39 to the cleaner 27.

The method is designed for flexibility in allowing variation in the operation of the rougher bank 25, either as a rougher only or as a rougher and a scavenger. The design also allows for the number of cleaning stages to be varied, eg. by cutting out the cleaner 35 and sending the concentrate for the cleaner 31 directly to leaching.

The applicant has carried out pilot plant work on a method of improving flotation performance of fine lead and silver particles which is based on the above-described flowsheet and also includes a zinc circuit for the tailings from the lead circuit. The pilot plant work confirmed that pH adjustment of fines enables significantly higher recoveries of lead mineral and silver minerals from a fine particulate stream.

Many modifications may be made to the preferred embodiment of the present invention described above without departing from the spirit and scope of the present invention.

The invention claimed is:

1. A method of recovering a valuable component in the form of silver and lead from a feed slurry in a minerals processing plant for a mined material in the form of a silver and lead deposit that includes lead sulfides which method includes the steps of:

(a) separating the feed slurry containing said silver and lead on the basis of particle size into at least two streams, with one stream being a fines stream;
(b) adjusting the pH of at least the fines stream to be within a range in which the pH is 3-5 wherein contaminants on the surface of particles in the split stream are soluble and thereby dissolving contaminants from the surface; and
(c) subjecting the pH adjusted fines stream to flotation by floating the valuable component including silver and lead from the pH adjusted fines stream.

2. The method defined in claim 1 wherein the mined material includes metal sulphides that have surface contaminants due to mineral oxidation species or metal hydroxides.

3. The method defined in claim 1 wherein the flotation step (c) includes a lead flotation circuit.

4. The method defined in claim 3 wherein the feed slurry for step (a) is a feed slurry to the lead flotation circuit or a tails slurry from the lead flotation circuit.

5. The method defined in claim 1 wherein the mined mineral is a lead and zinc deposit that includes lead sulphides and zinc sulphides and the valuable component is silver, lead and zinc and the flotation step (c) includes a lead flotation circuit and a zinc flotation circuit.

6. The method defined in claim 5 wherein the lead flotation circuit precedes the zinc flotation circuit, and the feed slurry for step (a) is any one or more of:

(i) a feed slurry to the lead flotation circuit;

(ii) a tails slurry from the lead flotation circuit, which serves as a feed slurry to the zinc flotation circuit; and (iii) a tails slurry from the zinc flotation circuit.

7. The method defined in claim 6 wherein the feed slurry for step (a) is a feed slurry to the lead flotation circuit.

8. The method defined in claim 1 wherein the flotation step (c) includes a talc flotation circuit.

9. The method defined in claim 1 wherein the pH range is 3.5-4.5.

10. The method defined in claim 1 wherein the pH range is 4-4.5.

11. The method defined in claim 1 wherein the fines are 10 micron or less in a fines stream produced in step (a).

12. The method defined in claim 11 wherein the fines are 5 micron or less.

13. The method defined in claim 1 wherein the pH adjustment step (b) includes adding an acid to the feed slurry to adjust the pH to be within the required range.

14. The method defined in claim 1 wherein the pH adjustment step (b) includes providing a contact time for the contaminants to dissolve.

15. The method defined in claim 14 wherein the contact time period is at least 5 minutes.

16. A method of recovering a valuable component in the form of silver, lead, and zinc from a feed slurry in a minerals processing plant for a mined material which includes the steps of:

(a) separating the feed slurry on the basis of particle size into at least two streams, with one stream being a fines stream;

(b) adjusting the pH of at least the fines streams to be within a range in which contaminants on the surface of particles in the split stream are soluble and thereby dissolving contaminants from the surface; and (c) floating the valuable component from the pH adjusted fines stream by floating lead and silver in the pH adjusted fines stream from step (b) in a lead flotation circuit; and floating zinc and silver in a tails stream from the lead flotation circuit in a zinc flotation circuit.

17. The method defined in claim 16 including adding a zinc depressant and a lead/silver collector to the pH adjusted fines after pH adjustment step (b).

18. The method defined in claim 17 including adding the lead/silver collector just before and/or during step (c)(i) of floating the lead and silver in the pH adjusted fines stream in the lead flotation circuit.

* * * * *